United States Patent [19]

Liska et al.

[11] Patent Number: 5,067,536

[45] Date of Patent: Nov. 26, 1991

[54] METHOD FOR MAKING STRUCTURAL PRODUCTS FROM LONG, THIN, NARROW, GREEN WOOD STRANDS

[76] Inventors: Frank T. Liska; Frank F. Liska, both of 1403 - 1770 Davie Street, Vancouver, British Columbia V6G 1W4, Canada

[21] Appl. No.: 476,077

[22] Filed: Feb. 7, 1990

[51] Int. Cl.[5] ..... B27M 1/02

[52] U.S. Cl. ..... 144/361; 144/348; 144/352; 144/364; 144/380; 264/108; 264/109; 264/115; 428/17; 428/151; 428/294

[58] Field of Search ..... 144/360, 361, 362, 366, 144/367, 369, 380, 364, 352, 348; 156/264; 428/17, 106, 107, 111, 113, 151, 249, 294; 264/108, 109, 115

[56] References Cited

U.S. PATENT DOCUMENTS

| | | | |
|---|---|---|---|
| 3,674,219 | 9/1972 | Harvey, Jr. | 144/367 |
| 4,232,067 | 11/1980 | Coleman | 144/361 |
| 4,421,149 | 12/1983 | Barnes et al. | 144/366 |
| 4,672,006 | 6/1987 | McGraw | 144/362 |
| 4,681,146 | 7/1987 | Liska et al. | 144/369 |

*Primary Examiner*—W. Donald Bray

[57] ABSTRACT

High quality agglomerated structural boards, lumber and other structural members such as I, U, T, L beams or corrugated plates or moldings are produced from engineered long, thin narrow green wood strands. Process, in which the parallel alignment of the strands to each other and their original starting orientation are maintained through their transportation, drying, blending, forming and pressing, preventing their intermingling, twisting, warping and breaking. The application of fungicides, pesticides, fire retarding and other chemicals during the blending process, impregnates or colors the agglomerated structural products throughout their cross section, making the products resistant against rot, insects, fire or aesthetically attractive for architectural applications.

8 Claims, 1 Drawing Sheet

Figure 1:
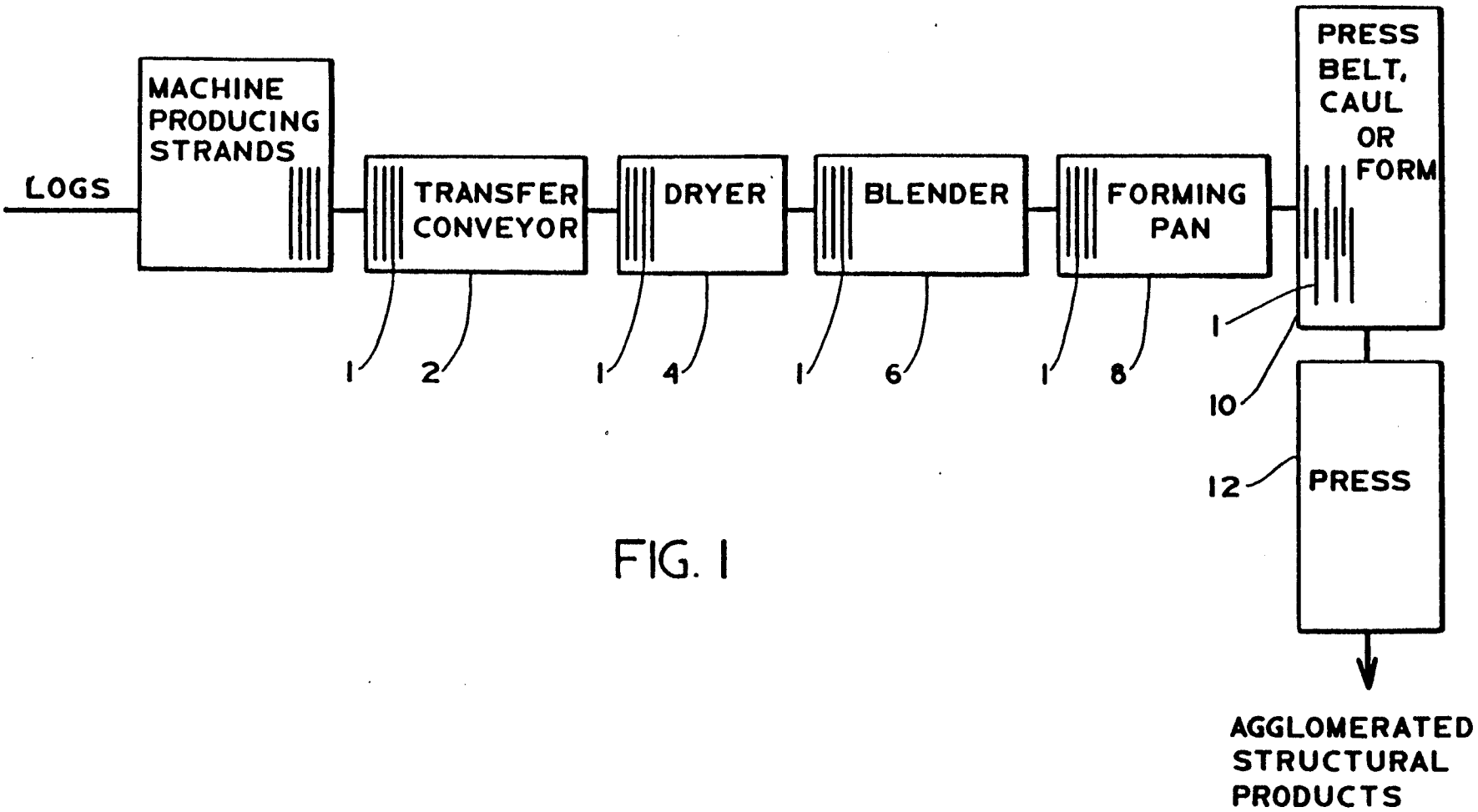

METHOD FOR MAKING STRUCTURAL PRODUCTS FROM LONG, THIN, NARROW, GREEN WOOD STRANDS

This invention relates to the method of manufacturing of high quality agglomerated structural board, lumber and other structural members, such as I, U, T, L beams or corrugated plates and moldings from engineered, long, thin, narrow, green wood strands.

In the contemporary art of the production of structural members, sawing is the main current method of converting wood logs to lumber, which is then further processed into final shapes and sizes of final products. At the primary conversion of logs to lumber, as well as at the secondary conversion of lumber into final product, a significant amount of wood becomes residue, such as edgings, trimmings, sawdust and shavings, so that only about one quarter of the raw material from logs remains in the final product.

The main drawback of the current wood technology is that wood is used in its natural state with all the natural defects and natural variable density, all of which have an adverse effect on the properties of the final product. As a result of that, wood components used in wood structures have to be oversized, according to the minimum strength at the points of natural defects.

Another drawback of the current sawing technology is apparent when small diameter logs from young tree plantations have to be sawn. Only small sizes of lumber can be cut from small logs and simultaneously high amount of residue is generated. Furthermore, the lumber cut from the logs harvested in the tree plantations, contains high percentage of juvenile wood. Because juvenile wood shrinks in the direction of the wood grain by approximately 10%, while mature wood shrinks in the wood grain direction by approximately 0.5% only, the lumber from young trees has a tendency to warp and twist during the drying process due to the internal tension. All dimensional changes cease in the dried lumber, however, the lumber remains warped and twisted. The warping and twisting may be prevented if lumber is firmly held so that the internal tension disappears during the drying process. The lumber released from the holding clamps after drying remains straight. However, clamping of individual pieces of lumber for drying is not practical and economically not feasible.

It is apparent that diminishing availability of large diameter sawlogs, increasing supply of small diameter logs from tree plantations and strong market demand for high quality structural components may be solved only through manufacturing of new types of agglomerated structural boards, lumber and other structural components from long, preferably engineered wood strands.

The attempts to make agglomerated structural components have been made by many scientists. The early patent for a "Method of Producing Structural Board or Final Products from Wood" was filed on Jan. 28, 1955 and the patent 93154 was issued by the Czechoslovak Patent Office on Dec. 15, 1959. The claims relate to a process for producing structural products from elongated strands 10 mm to 1,000 mm in length and 0.01 $mm^2$ to 300 $mm^2$ in cross section, by either activation cf natural binding chemicals contained in wood by adjusting of hydrothermal conditions during the process or by addition of suitable binder and consolidating to a desired form in a heated press.

U.S. Pat. No. 4,061,819, issued on Dec. 6, 1977, describes similar process of making structural lumber from adhesively bonded strands with 1% to 5% of adhesive solids. The strands are claimed to be at least 12 inches or even 24 inches long, of average width 0.5 inch to 0.25 inch and average thickness 0.05 inch to 0.5 inch. The tests described in the patent show that the longer the strands used, the smaller the amount of adhesive needed to be applied for the production of high quality agglomerated lumber. Longer strands used in the production also required lower compression during the pressing, resulting in high quality agglomerated lumber at lower density.

However, the apparent advantage of long, green strands for the production of agglomerated structural boards, lumber or molded products has not yet been fully utilized by the industry because the industrial machines available on the market can produce usable strands of a maximum length of 12 inches only. But even 12 inch long strands dictate that the starting wood log must be of high quality and very straight. Strands made on the available industrial slicing machines are broken into random width along the wood grain. Crooked logs with twisted grain will cause breakage of long strands or that the strands will not be separated completely, will be produced with many checks and will, therefore, interlock with each other. Interlocked, bundled strands will prevent smooth passage through the dryer and the blending system and consequently disrupt the parallel orientation of the strands, which is required for good quality of agglomerated structural products. Drying of 12 inch long strands will also result in high percentage of broken strands into short pieces, which should be removed from the process. The disposal of the already dried short broken strands affects negatively the economy of the production. Furthermore, even 6 inch long strands of irregular width, especially those cut from juvenile wood, will twist and split during the drying process so that the strand orientation is further negatively affected, resulting in higher consumption of adhesive and lower quality of agglomerated structural products.

The advanced technology for the production of long, engineered strands is described in the Canadian Patent No. 1,192,474 issued on Aug. 27, 1985 and the U. S. Pat. No. 4,681,146, issued on July 21, 1987. The patents claim the production of engineered strands where all dimensions of the strands are cut, not broken, to predetermined values. The ends and sides of strands may be cut at acute angles so that the consolidation of the strands during the pressing process will be better, lower pressing forces may be applied and high quality of agglomerated structural boards, lumber or moldings at lower density may be produced.

The great advantage of the new strand slicing system described in the patents mentioned above is that the strands fall down, out of the machine, parallel to each other, which cannot be achieved on any of the existing strand making machines currently available on the market. The features of the new strand slicing machine will enable the production of agglomerated oriented structural boards, lumber and other profiled structural products in a most economical way from green wood, if the parallel alignment of the long strands can be maintained throughout the production process without the strands breaking, twisting, intermingling or interlocking.

Therefore, the object of our invention is to introduce an economical production of high quality agglomerated structural boards, lumber and other structural products such as I, U, T, L beams or corrugated plates and moldings from engineered long, narrow, thin, green strands, produced on a suitable long strand making machine, which are collected on a transfer conveyor, through proper handling of long strands without breaking, twisting or interlocking.

Another object of our invention is to dry long, thin, narrow green strands to desired moisture content, again without their interlocking, twisting or breaking into short pieces, and simultaneously letting the long strands, especially those made from logs containing high percentage of juvenile wood, to shrink without warpage or twisting, so that dried strands will be completely relieved of the internal stresses.

Another object of our invention is to secure proper blending of long, thin, narrow strands without their interlocking.

Another object of our invention is to secure the impregnation of the products throughout their cross section by the application of fungicides, insecticides, fire retardants or other chemicals during the blending process.

Yet another object of our invention is to lay the long, thin, narrow strands parallel to each other on a press belt, cauls or forms, again without interlocking, twisting or crisscrossing so that the best mechanical properties of the agglomerated structural boards, lumber or moldings can be achieved.

Further objects of our invention will appear from the detailed description of a number of embodiments described hereinafter with reference to the drawing. It is to be understood that the present invention is in no way limited to the details of such embodiments but is capable of numerous modifications within the scope of the appended claims.

Referring to the accompanying drawing, FIG. 1 diagrammatically illustrates the mechanical system for carrying out the method in accordance with this invention.

The strands 1 of predetermined length, width and thickness are collected continuously into a mat on a transfer conveyor 2 moving at right angle to the longitudinal edges of the strands 1 so that the width of the mat corresponds to the length of the strands 1. Depending on the local logging practices, the length of the strands 1 may be about 1,000 mm or 4 ft., i.e. the same length as the length of wood logs normally used in their production. Since the parallel orientation of the strands 1 is maintained throughout the mat transfer to the dryer, interlocking and breaking of the strands 1 is eliminated.

The mat of strands 1 is transferred into a screen type dryer 4, where the strands 1, carried through the dryer, are dried in a similar way as the veneer in a continuous dryer in the production of plywood. The mat of strands 1 is contained during the drying process between two endless screen belts. The bottom screen belt carries the mat of strands 1 forward, while the top hold-down screen belt, lying on the mat of strands 1 and moving at the same speed and in the same direction as the bottom screen belt, restrains the strands 1 from twisting, curling, warping, intermingling or interlocking. However, the creep due to the shrinkage of strands 1 during the drying process is not restricted. This is very important especially when the strands 1 are produced from young logs, containing high percentage of juvenile wood, which is subjected to a high level of longitudinal shrinkage during the drying process. The internal tension in the constrained strands 1 disappears completely during the drying process and the strands 1 remain flat and straight after release from the dryer 4.

The width of the dryer 4 corresponds practically to the length of the strands 1 and, therefore, to the width of the strand mat. The dryer 4 may be a single pass or a multiple pass type, in which the mat of strands 1 enters the top pass and is discharged from the dryer 4 from its bottommost pass. The design of the dryer 4 depends on the capacity of the line producing agglomerated structural products, on the moisture content and the species of the starting wood.

Again, the strands 1 do not change their orientation, which remains the same as the starting orientation of the strands 1 being deposited on the transfer conveyor 2.

The last section of the dryer 4 serves as a cooler. The cooling of the hot strands is necessary in order to prevent precure of the resin applied in the following blender 6.

The dry and cooled strands 1 are transferred into a blender 6 comprising of a set of downward cascading screens, vibrating in the direction of the mat flow, i.e. at right angle to the longitudinal edges of the strands 1. Cascading and vibrating screens allow the roll over of the strands 1 so that the resin may be spread on both sides of the strands 1. The resin may be in liquid or dry powder form. Liquid adhesive, being less costly, may be preferred. However, the coverage of the surface of the strands 1 may not be uniform, some strands 1 may show voids, being shielded from the spray nozzles by the overlying strands 1, the addition of powdered resin in the second section of the blender 6 may be required. On the other hand, powdered resin will penetrate even into the gaps between the adjacent strands 1 and will adhere to the surface of the strands 1. The adherence of powdered resins to the surface of wood flakes is well known in the industry producing waferboard and oriented strand board. Simultaneously with resin, small amounts of wax, fungicides, pesticides, preservatives, fire retarding agents, catalysts or other chemicals, improving the mechanical properties of agglomerated structural products or their aesthetical appearance, may be added. The sequence of the application of resins and other additives may be arranged to achieve the most economical process.

Again, the strands 1 do not change their orientation, which remains the same as the starting orientation of the strands 1 on the transfer conveyor 2.

The strands 1 covered with resin and other chemicals are then discharged from the blender 6 in the same oriented manner onto a vibrating forming pan 8 which is simultaneously moving slowly back and forth in the direction of the flow of the strands 1, i.e. in the direction at right angle to the longitudinal edges of the strands 1. The forward and backward movement of the forming pan 8 corresponds to the width of the required final product. The strands 1 are thus evenly spread across the width of the press belt, cauls or forms 10. Again, the strands 1 do not change their orientation, which remains the same as the starting orientation of the strands 1 on the transfer conveyor 2.

A feature of our invention is the formation of a continuous mat in which the strands 1 overlap lengthwise, but they remain parallel to each other and their orientation remains the same as the starting orientation of the strands 1 on the transfer conveyor 2. The strands 1, being deposited by the vibrating forming pan 8 on the press belt, cauls or forms 10, are distributed lengthwise, i.e. in the direction of their longitudinal edges. This distribution is managed through forward movement of the press belt, cauls or forms 10 passing under the vibrating forming pan 8. Faster movement is required for thin products, slower movement for thicker products, so that adequate thickness of the strand mat in which the strands 1 are laid in an overlapping mode, like roof shingles or like fish scales, may be formed. To limit the repose angle of the overlapping strands 1 to an acceptable degree in thick agglomerated structural products, the press belt, cauls or forms 10 have to pass several times back and forth under the vibrating forming pan 8, before the mat enters the heated press 12, where the mat will be consolidated through heat and pressure into a high quality agglomerated structural board, lumber or molded products.

The mechanical and aesthetical properties of the structural products may be determined by the quality and quantity of adhesives, resins and other chemicals applied to the strands 1 in the blender 6 and by the degree of mat compression in the press 10.

From the above it will be readily understood that the method described above will attain the object of the invention.

Prior art of making structural board, lumber or molded structural components from long, green strands made from low quality logs of underutilized wood species does not exist. The design of flakers available on the market does not allow cutting of strands longer than 12 inches. The breaking of strands to a random width results in irregular splitting and checking, so that the strands may easily interlock, form bundles, which will slow down the passage of the strands through the dryer, and thus cause fires and explosions in the dryer. Furthermore, high percentage of long strands will be broken into short pieces. To maintain high quality of agglomerated structural products, short pieces of strands should be removed from the furnish. However, additional breakage of strands will occur during blending, transportation and even in the process of strand orientation in the forming station. And, finally, the orientation of intermingled and bundled strands into parallel alignment, required for high quality of agglomerated structural products, will be very difficult, practically not possible at all.

In our novel system, the long strands do not change their orientation throughout the process, from the strand producing machine to the finished agglomerated structural product. Thus intermingling and breaking of long strands during transportation, drying, blending and orientation into the final product, is completely avoided.

In our novel system, long strands do not intermingle, twist or break into short pieces in the dryer, being contained between screen belts, yet allowing for creep of strands caused by their shrinking.

In our novel system, long strands do not intermingle, twist or break into short pieces in the blender, being loosely transferred forward in a cascading mode, thus allowing proper coverage of their surfaces with resin and other chemicals, if required.

In our novel system, long strands do not intermingle, twist or break into short pieces during the final mat forming process, yet they are loose so that individual strands may be deposited into a long mat with strands lying parallel to each other, their ends overlapping like roof shingles or fish scales.

It has to be stressed that our novel production system will assure a highly economical production of agglomerated structural boards, lumber, moldings and other structural members by:

enabling the production of large dimension agglomerated lumber and other structural members from small diameter logs, enabling the production of agglomerated members of high stability, eliminating internal stress of juvenile wood during the drying process of the long strands, enabling the production of agglomerated structural members from underutilized wood species, enabling the production of agglomerated structural members of predetermined engineered qualities, enabling the production of agglomerated structural members of constantly uniform and guaranteed mechanical properties, enabling the production of agglomerated structural members chemically treated against rot and insects or for aesthetical effects throughout the cross section, which cannot be achieved in sawn lumber, enabling the production of agglomerated structural members highly resistant to fire throughout their cross section, more than doubling the yield of raw logs converted into structural board, lumber and other structural members by eliminating the breakage of strands, generation of edgings and most of the sawdust and shavings, enabling the production of new types of agglomerated structural board, lumber, I, U, T, L members, corrugated plates and moldings required by the market for their mechanical properties or aesthetical appearance.

The embodiments of the invention in which an exclusive property or privilege is claimed are defined as follows:

1. A process for producing a high quality agglomerated structural member from engineered long, thin, narrow, green wood strands having a longitudinal axis, said strands remaining parallel to each other throughout the process, the process comprising:

feeding the strands from a strand producing machine onto a transfer conveyor with an orientation whereby the longitudinal axes of the strands is transverse to the direction of motion of the strands;

feeding said strands into a screen dryer while maintaining said orientation;

confining said strands in the said dryer between a bottom screen belt and a top screen belt while maintaining said orientation, said screen belts preventing intermingling and breaking of said strands while allowing said strands to shrink in all directions during the drying process;

subjecting the strands in the dryer to a drying medium that penetrates through said screen belts while maintaining said orientation and transporting said screen belts and said strands confined between them at identical speed through the dryer;

feeding said strands into a cooling section of said dryer while maintaining said orientation;

confining said strands in said cooling section between a bottom screen belt and a top screen belt while maintaining said orientation, said screen belts preventing intermingling and breaking of said strands;

subjecting said strands in the cooling section to cooling air that penetrates through said screen belts while transporting said screen belts, with said strands confined between them and maintained in said orientation, at identical speed through the cooling section;

feeding said strands into a blender while maintaining said orientation, said blender comprising a set of carrying screens cascading downwardly and vibrating in the direction of motion of said strands;

spraying said strands with resin in said blender;

discharging said strands onto a vibrating forming pan while maintaining said orientation, said pan vibrating in the direction of motion of the strands and declining slightly in the direction of said motion, said pan simultaneously moving slowly forward and backward in said direction of motion a predetermined distance;

transferring said strands onto a moving receiving member to spread said strands over a predetermined width to form a mat on said receiving member of a width equal to the predetermined distance formed by backward and forward movement of the forming pan, said receiving member moving back and forth in a direction parallel to the longitudinal axes of the strands to enable forming of a mat of strands that overlap longitudinally with each other; and transferring said mat of strands into a heated press and compressing the mat, covered with resin, to produce the structural member.

2. A method according to claim 1, wherein said dryer is a multiple pass type dryer.

3. A method as claimed in claim 1 in which said structural member is selected from the group consisting essentially of board, lumber, I, U, T and L beams, moldings and corrugated plates.

4. A process as claimed in claim 1 in which the resin sprayed in the blender is a liquid resin.

5. A process as claimed in claim 1 in which the resin sprayed in the blender is a powdered resin.

6. A process as claimed in claim 1 in which the strands are treated in the blender with wax to prevent water absorption.

7. A process as claimed in claim 1 in which the strands are treated in the blender with chemicals to prevent rot, to resist insects and to impart fire retardency.

8. A process as claimed in claim 1 in which the receiving member that receives the strands from the vibrating forming pan is selected from the group consisting essentially of a press belt, a caul and a form.

* * * * *